US011510489B2

(12) United States Patent
March

(10) Patent No.: US 11,510,489 B2
(45) Date of Patent: Nov. 29, 2022

(54) FLUTE LYRES

(71) Applicant: Joseph David March, Kirksville, MO (US)

(72) Inventor: Joseph David March, Kirksville, MO (US)

( * ) Notice: Subject to any disclaimer, the term of this patent is extended or adjusted under 35 U.S.C. 154(b) by 0 days.

(21) Appl. No.: 17/546,846

(22) Filed: Dec. 9, 2021

(65) Prior Publication Data

US 2022/0218103 A1 Jul. 14, 2022

Related U.S. Application Data

(60) Provisional application No. 63/205,803, filed on Jan. 8, 2021.

(51) Int. Cl.
*A47B 23/00* (2006.01)

(52) U.S. Cl.
CPC ..... *A47B 23/004* (2013.01)

(58) Field of Classification Search
None
See application file for complete search history.

(56) References Cited

U.S. PATENT DOCUMENTS 547,977 A 10/1895 Weiss
1,495,131 A 5/1924 Griffith
1,539,042 A * 5/1925 Dennis ..... A47B 23/004 248/443
1,649,217 A * 11/1927 Eshleman ..... A47B 23/004 248/444
1,675,834 A * 7/1928 Young ..... A47B 23/004 248/444
1,772,478 A 8/1930 Carne
2,792,666 A * 5/1957 Green ..... A47B 23/004 248/443
2,827,732 A 3/1958 Shumaker
4,109,888 A 8/1978 Hayes
D280,417 S * 9/1985 Koprivica ..... D17/99
9,622,572 B1 * 4/2017 Moore ..... A47B 23/004
10,117,512 B1 * 11/2018 Moore ..... G10G 1/02

* cited by examiner

*Primary Examiner* — Steven M Marsh
(74) *Attorney, Agent, or Firm* — Harness, Dickey & Pierce, P.L.C.; David J. Tucker

(57) ABSTRACT

A flute lyre includes a music holder and a body attached to the music holder. The body includes a neck member, a support member, and an arm member extending between the neck member and the support member. The support member includes a base support and a music holder support. The neck member is configured to extend about and contact a user's neck, and the base support is configured to contact the user's torso when the flute lyre is positioned on the user. The music holder support is positioned on an exterior side of an arm of the user, and the arm member is positioned between the user's arm and the user's torso for contacting the user's arm when the flute lyre is positioned on the user and the user holds the flute in the playing position. Other example flute lyres and methods of constructing flute lyres are also disclosed.

20 Claims, 6 Drawing Sheets

FLUTE LYRES

CROSS-REFERENCE TO RELATED APPLICATIONS

This application claims the benefit and priority of U.S. Provisional Application No. 63/205,803, filed Jan. 8, 2021. The entire disclosure of the above application is incorporated herein by reference.

FIELD

The present disclosure relates to flute lyres.

BACKGROUND

This section provides background information related to the present disclosure which is not necessarily prior art.

Lyres are commonly employed by users playing musical instruments such as flutes, trumpets, clarinets, etc. This allows users to read music and play their instruments while marching in a parade, marching on a football field, performing in stands, etc. Conventional lyres typically include spring clamps for holding sheet music, and one or more rods for securing the lyres to musical instruments. Alternatively, some conventional lyres such as flute lyres may be secured to or held in place by a user. For example, some conventional flute lyres wrap around a forearm region of the user.

SUMMARY

This section provides a general summary of the disclosure, and is not a comprehensive disclosure of its full scope or all of its features.

According to one aspect of the present disclosure, a flute lyre positionable on a user is disclosed. The flute lyre includes a music holder configured to receive at least one piece of sheet music, and a body attached to the music holder. The body includes a neck member, a support member, and an arm member. The neck member is configured to extend about and contact a posterior side of a neck of the user when the flute lyre is positioned on the user. The support member includes a base support and a music holder support extending between the base support and the music holder. The base support is configured to contact an anterior side of a torso of the user when the flute lyre is positioned on the user. The music holder support is positioned on an exterior side of an arm of the user when the flute lyre is positioned on the user and the user holds the flute in a playing position. The arm member extends between the neck member and the support member. The arm member is positioned between the user's arm and the anterior side of the user's torso for contacting the user's arm when the flute lyre is positioned on the user and the user holds the flute in the playing position.

According to another aspect of the present disclosure, a method of forming a flute lyre from one continuous piece of wire is disclosed. The flute lyre is positionable on a user for allowing the user to read a piece of sheet music when the user holds a flute in a playing position. The method includes bending an intermediate portion of the wire into a triangle configuration to form a base support configured to contact an anterior side of a torso of the user when the flute lyre is positioned on the user, twisting the wire at an apex of the triangle configuration to form an arm member extending in a first direction and a music holder support extending in a second direction, bending the wire into a looped configuration to form a neck member extending from the arm member, and attaching a music holder to the music holder support at an end of the wire. The neck member is configured to extend about and contact a posterior side of a neck of the user when the flute lyre is positioned on the user.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts and/or features throughout the several views of the drawings.

DETAILED DESCRIPTION

Figure 1:
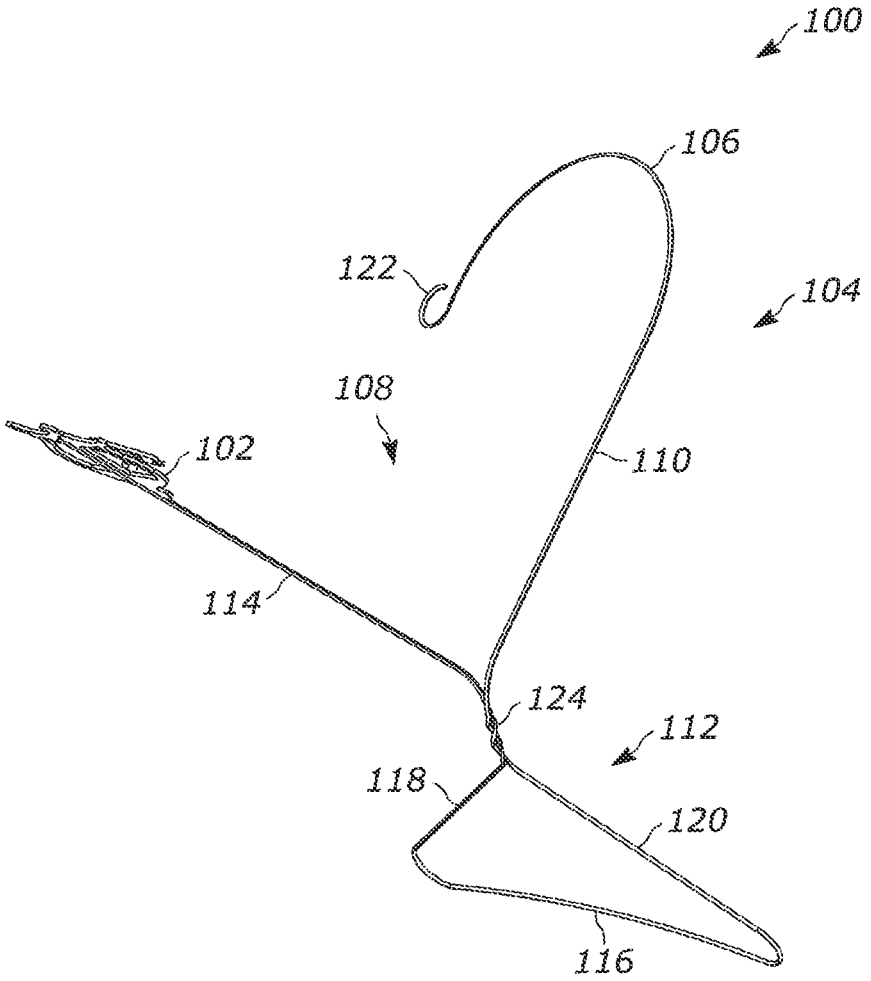
FIG. 1 is a perspective view of a flute lyre, according to one example embodiment of the present disclosure.
Figure 2:
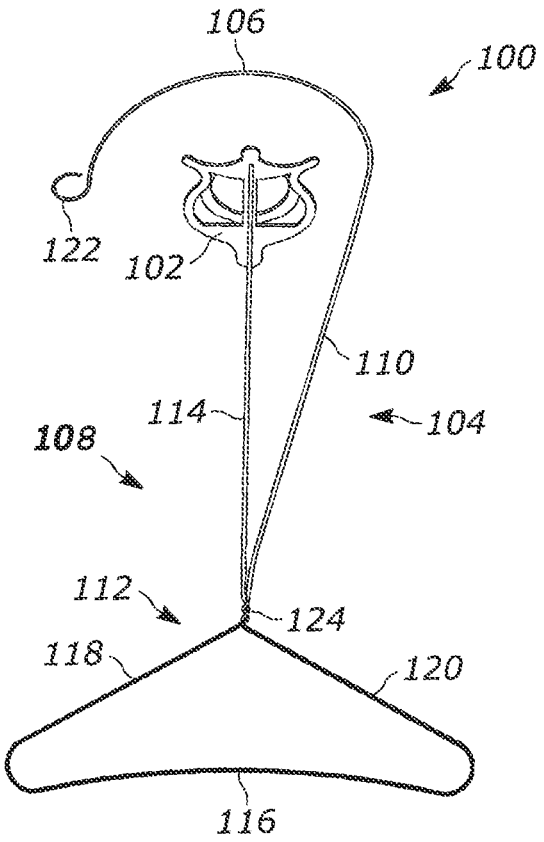
FIG. 2 is a front view of the flute lyre of FIG. 1.
Figure 3:
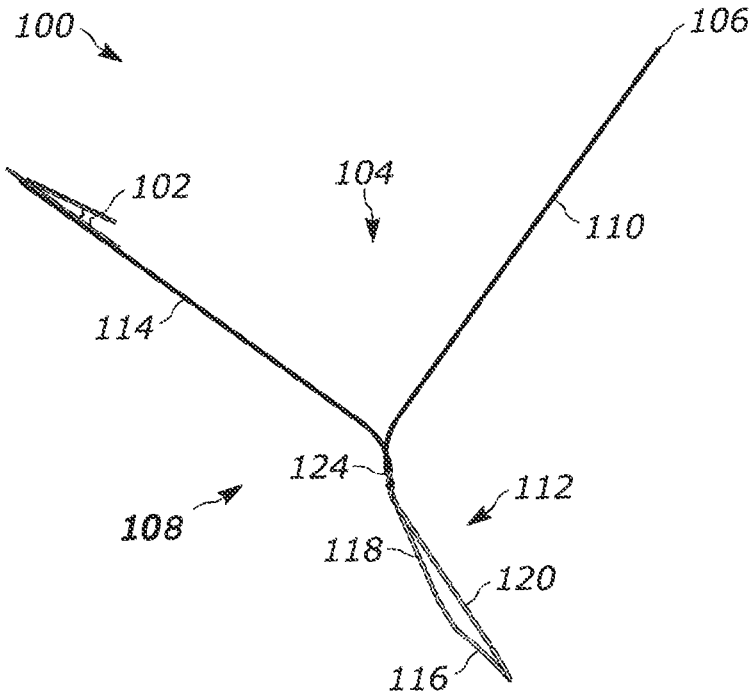
FIG. 3 is a side view of the flute lyre of FIG. 1.

Example embodiments will now be described more fully with reference to the accompanying drawings.

Flute lyres are commonly employed by flute and piccolo players to allow the players to read music and play their instruments while marching in a parade, marching on a football field, performing in stands, etc. As recognized by the inventor, conventional flute lyres are typically unstable and tend to bounce when the players move. Such movement of a flute lyre relative to the player may cause a flute or piccolo player to have difficulties reading music, and in some cases, prevent the flute or piccolo player from reading music.

Uniquely, flute lyres disclosed herein provide stability when a player moves. For example, when the player moves (e.g., marches, turns, etc.), the flute lyres disclosed herein remain stable against the player's body without the lyres bouncing as with conventional flute lyres. This allows the player to read music and play a flute (including a piccolo) while marching in a parade, marching on a football field, performing in stands, etc.

For example, a flute lyre according to one example embodiment of the present disclosure is illustrated in FIGS. 1-6, and indicated generally by reference number 100. As shown in FIGS. 1-6, the flute lyre 100 includes a music holder 102 for receiving at least one piece of sheet music, and a body 104. As shown, the body 104 includes a neck member 106, a support member 108, and an arm member 110. The support member 108 includes a base support 112, and a music holder support 114 extending between the base support 112 and the music holder 102. The arm member 110 extends between the neck member 106 and the support member 108.

Figure 4:
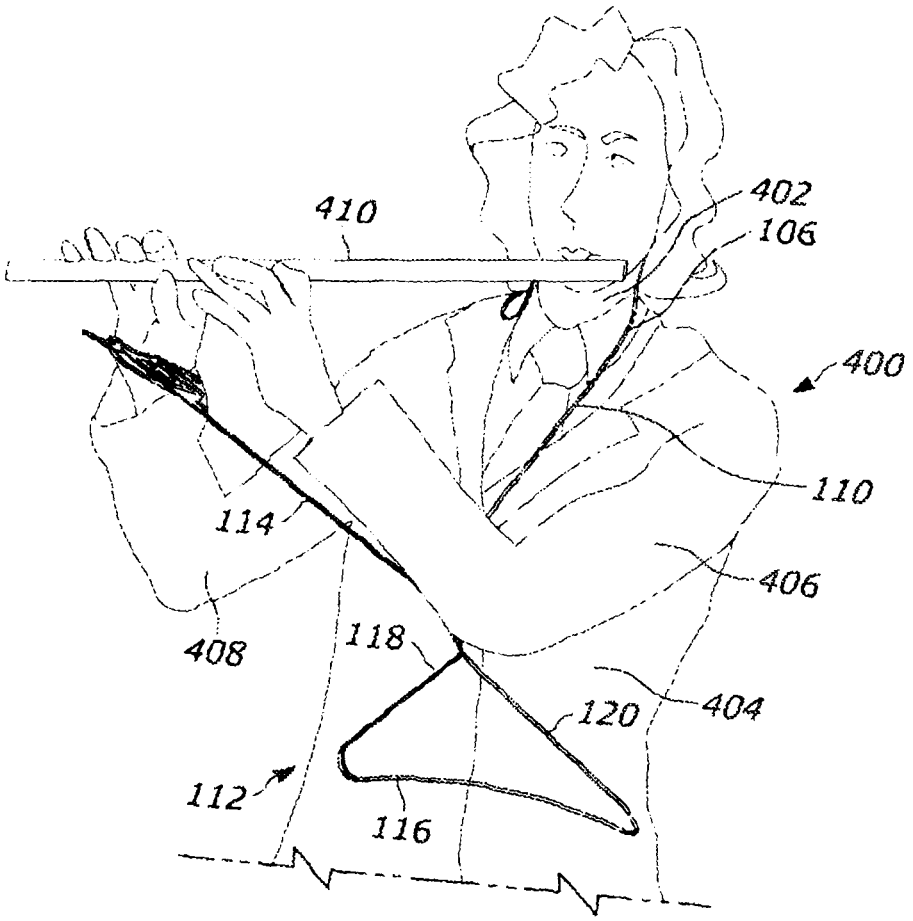
FIG. 4 is a perspective view of a user holding a flute in a playing position and the flute lyre of FIG. 1 positioned on the user, according to another example embodiment.

The flute lyre 100 is positionable on a user (e.g., a flute player) for allowing the user to read a piece of sheet music when the user holds a flute in a playing position. In such examples, various components of the lyre 100 are positioned in specific locations on the user's body. For example, FIG. 4 illustrates a user 400 holding a flute 410 in a playing position, where the flute lyre 100 is positioned on the user 400. As shown, the user 400 has a neck 402, a torso 404, and left and right arms 406, 408.

In the example of FIG. 4, the neck member (e.g., a neck loop) 106 of the lyre 100 extends about a posterior side (e.g., a back side, a rear side, etc.) of the user's neck 402. Specifically, the neck member 106 extends around the left side and the posterior side of the user's neck 402. In such examples, the neck member 106 may extend partially or entirely around the user's neck 402. For example, in FIG. 4, the neck member 106 extends about 270 degrees around the user's neck 402. In other examples, the neck member 106 may extend more or less than 270 degrees around the neck 402. For example, the neck member 106 may extend 180 degrees, 300 degrees, 360 degrees, etc. around the neck 402.

As shown in FIG. 4, the music holder support 114 and the arm member 110 of the lyre 100 extend in different directions from the base support 112, and create a "V" configuration. For example, the music holder support 114 extends from the base support 112 and away from the user 400, and the arm member 110 extends from the base support 112 and towards the user 400. In some examples, the music holder support 114 and the arm member 110 may be separated by an angle of about 75 degrees, about 90 degrees, about 115 degrees, etc.

By extending in different directions, the music holder support 114 and the arm member 110 define an opening therebetween for receiving the user's left arm 406. For example, the music holder support 114 is positioned on an exterior side of the user's left arm 406, and the arm member 110 is positioned between the user's left arm 406 and an anterior side (e.g., a front side, etc.) of the user's torso 404. In such examples, a forearm of the user's left arm 406 is positioned (e.g., in the opening) between the music holder support 114 and the arm member 110. In other words, the user's left arm 406 extends through the "V" created with the music holder support 114 and the arm member 110 when the lyre 100 is positioned on the user 400 and the user 400 holds the flute 410 in a playing position.

In the example of FIG. 4, the base support 112 of the lyre 100 extends between the music holder support 114 and the arm member 110, and the user's torso 404. In such examples, the base support 112 is positioned against an anterior side of the user's torso 404. For example, the base support 112 may be positioned against the user's abdomen region, chest region, etc.

As shown in FIG. 4, various components of the flute lyre 100 contact the user's body to ensure the lyre 100 is stable when the user 400 holds the flute 410 in a playing position. In such examples, the flute lyre 100 may contact the user 400 in three different locations. For example, the neck member 106 contacts the posterior side of the user's neck 402, the base support 112 contacts the anterior side of the user's torso 404, and the arm member 110 contacts the user's left arm 406 when the lyre 100 is positioned on the user 400.

In such examples, the user 400 may apply a downward force to the arm member 110 with the left arm 406. For example, to apply the downward force, the user 400 may simply rest the left arm 406 on the arm member 110, physically push downward on the arm member 110 with the left arm 406, etc. In some examples, the downward force may also be applied (at least partially) to the music holder support 114. When the downward force is applied to the arm member 110, the neck member 106 is forced against the posterior side of the user's neck 402 and base support 112 is forced against the anterior side of the user's torso 404 (e.g., the user's abdomen region, chest region, etc. of the user 400). This ensures the flute lyre 100 is stabilized against the user 400 and prevents substantial movement of the lyre 100 relative to the user 400.

In the example of FIGS. 1-4, the flute lyre 100 makes contact with the user 400, but not the flute 410. In other words, no portion of the body 104 contacts or otherwise attaches to the flute 410. In such examples, the flute 410 and the flute lyre 100 are independent of each other. As such, the flute 410 may move without causing movement of the flute lyre 100.

As shown in FIGS. 1-5, the base support 112 is a triangular-shaped support. Such a configuration provides stability when the support is forced against the user's torso 404. As shown, the triangular-shaped support includes a base segment 116 and opposing angled segments 118, 120. In such examples, the base segment 116 contacts the anterior side of the user's torso 404, as shown in FIG. 4. Although FIGS. 1-5 illustrate the base support 112 as a triangular-shaped support, other suitable shaped supports may be employed if desired.

Figure 5:
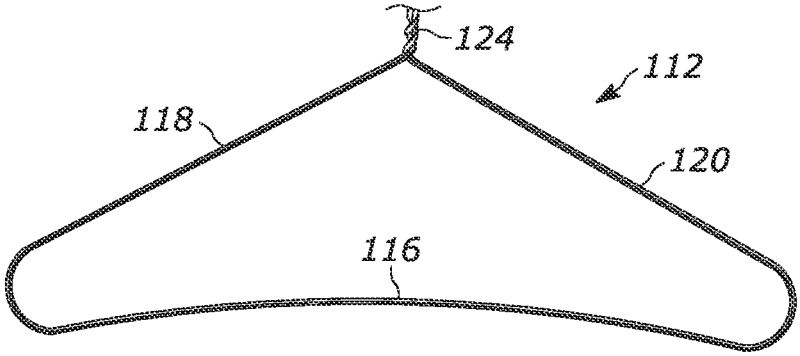
FIG. 5 is an enlarged view of a base support in the flute lyre of FIG. 1.
Figure 6:
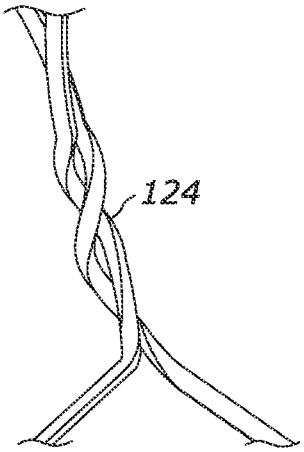
FIG. 6 is an enlarged view of an arm member and a music holder support in the flute lyre of FIG. 1, where the arm member and the music holder support are twisted together.

In some examples, the base segment 116 of the exemplary triangular-shaped support may be curved as shown in FIGS. 4 and 5. The curvature of the base segment 116 may vary depending on, for example, a user employing the lyre 100 (e.g., the user 400). For example, the curvature of the base segment 116 may correspond to the contour of user's torso 404 to increase stability when the triangular-shaped support is forced against the user's torso 404.

The triangular-shaped support may be any suitable size. For example, the base segment 116 may have a length of about six inches. In other examples, the base segment 116 may be longer or shorter depending on, for example, the size and shape of the user 400. In some examples, increasing the length of the base segment 116 may create a larger contact region between the base segment 116 and the user's torso 404. As a result, stability may be increased.

Additionally, the triangular-shaped support may have any suitable configuration. For example, the triangular-shaped support may have an equilateral configuration where the segments 116, 118, 120 are generally the same length. In other examples, the triangular-shaped support may have an isosceles configuration, where the segments 118, 120 are longer than the base segment 116.

As shown in FIGS. 1-4, the neck member 106 forms a hook configuration. For example, the neck member 106 extends in an arc to form a loop that at least partially extends about the user's neck 402. In some examples, an end portion of the neck member 106 may include an optional curl 122. The curl 122 may prevent the end portion of the neck member 106 from harming the user 400, ripping clothing, etc. when the lyre 100 is positioned on the user 400.

In the example of FIGS. 1-4, at least a portion of the flute lyre 100 is formed of wire. For example, in the embodiment of FIGS. 1-4, the neck member 106, the support member 108, and the arm member 110 may be formed of (and consist of) one continuous piece of wire. In other words, every component of the flute lyre 100 except for the music holder 102 may be formed of a single, continuous piece of wire. This configuration may increase stability of the lyre 100. In some examples, the continuous piece of wire may be seven gauge wire (e.g., galvanized wire). In other examples, the continuous piece of wire may be a heavier or lighter gauge if desired.

Additionally, and as shown in FIGS. 1-4 and 6, the arm member 110, the base support 112, and the music holder support 114 are coupled together at one location on the body 104. Specifically, the arm member 110 and the music holder support 114 meet at an apex of the base support 112. For example, portions of the arm member 110 and the music holder support 114 may be twisted at the apex of the base support 112. This forms a twist 124 between the arm member 110 and the music holder support 114. In some examples, the twist 124 may be formed by at least two and half turns (e.g., rotations) to add strength and stability to the lyre 100.

In some embodiments, the flute lyre 100 may be adjustable to accommodate different users. For example, any one (or more) of the neck member 106, the support member 108, and/or the arm member 110 may be adjusted to change a position of the music holder 102 relative to a user (e.g., the user 400). For instance, the position of the music holder 102 (and therefore the sheet music secured by the music holder 102) may be adjusted relative to the user. In such examples, the height of the music holder 102, the distance between the music holder 102 and the user's eyes, etc. may be adjusted by altering portions of the neck member 106, the music holder support 114, the arm member 110, and/or the base support 112.

Adjustments may be made by bending the neck member 106, the music holder support 114, the arm member 110, and/or the base support 112. For example, bending the music holder support 114 and/or the arm member 110 may change the angle between these components, thereby adjusting the height of the music holder 102 and the distance between the music holder 102 and the user's eyes. In other examples, the lengths of the neck member 106, the music holder support 114, and/or the base support 112 may be altered to adjust the position of the music holder 102. For example, decreasing (or increasing) the length of the arm member 110 raises (or lowers) the music holder 102.

As shown, the music holder 102 is attached to the music holder support 114 of the body 104. For example, the music holder 102 may be securely fastened to the music holder support 114 by any suitable manner. For instance, the music holder 102 may be brazed, soldered, welded, etc. to the music holder support 114.

The music holder 102 may be any suitable device for holding sheet music. For example, the music holder 102 may include a conventional spring clamp for holding sheet music.

Figure 7:
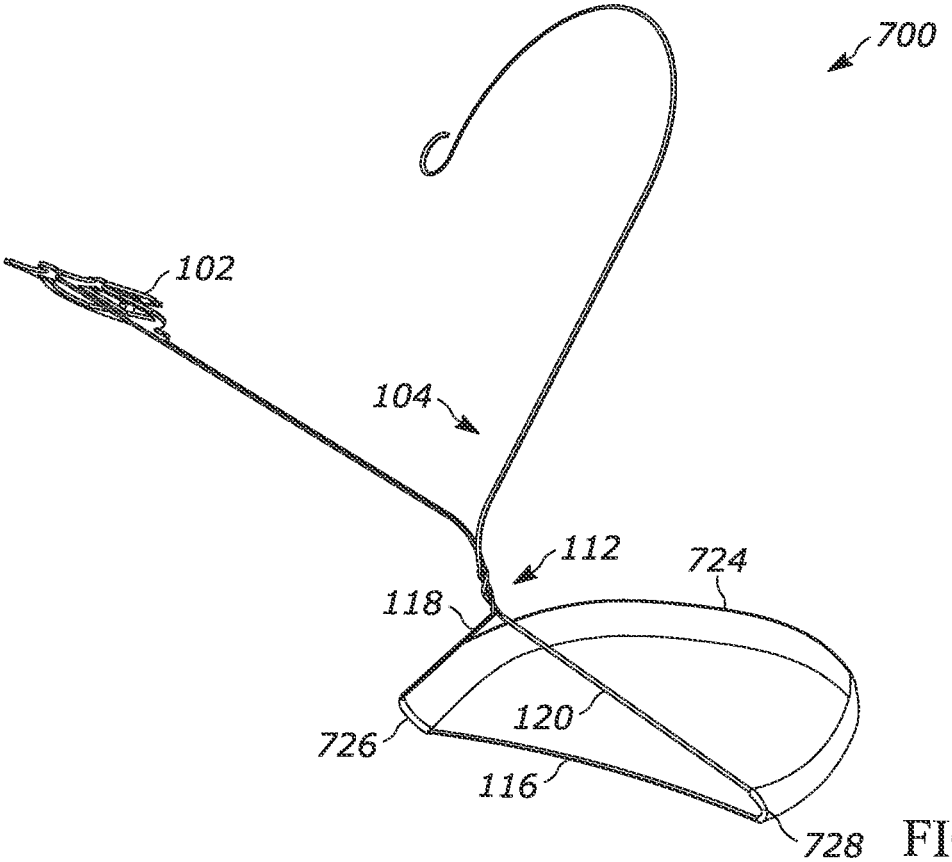
FIG. 7 is a perspective view of a flute lyre including a strap for securing the flute lyre to a user, according to another example embodiment.

In some embodiments, any one of the flute lyres disclosed herein may include an optional strap for securing the lyre to a user. For example, FIG. 7 illustrates a flute lyre 700 including the music holder 102 and the body 104 of FIGS. 1-4, and a strap 724. In such examples, the strap 724 is configured to extend about the user's torso.

In the example of FIG. 7, the strap 724 includes opposing ends 726, 728 attached to opposing sides of the base support 112 (e.g., the segments 118, 120 of the triangular-shaped support). For example, the ends 726, 728 of the strap 724 may adhered to the base support 112. In other examples, the ends 726, 728 may wrap around the opposing sides of the base support 112. In such examples, each end 726, 728 may be sewn, adhered, etc. to an adjacent portion of the strap 724. In still other examples, the ends 726, 728 of the straps 724 and the opposing sides of the base support 112 may include corresponding fasteners for removably attaching the strap 724 to the base support 112.

In some examples, the strap 724 may include two segments coupled together via a release structure. For example, the user may actuate the release structure to separate the two segments and/or connect the two segments of the strap 724. This may allow the user to easily secure the strap 724 to the user's body and/or release the strap 724 from the user's body. In such examples, the opposing ends 726, 728 of the strap 724 may be permanently or removably attached to the base support 112.

In other examples, the end 726 of the strap 724 may be permanently attached to the base support 112 and the end 728 of the strap 724 may be removably attached to the base support 112 via fasteners. In such examples, the user 400 may secure and/or release the strap 724 by actuating the fasteners.

In some examples, the strap 724 may be adjustable to accommodate different users. For example, the strap 724 may include an adjustment structure that allows the user to adjust the length of the strap 724.

Additionally, any one of the flute lyres disclosed herein may include one or more optional pads attached to at least portions of the neck members, the base supports, and/or the arm members disclosed herein. The pads may include any suitable material such as, for example, yarn, foam, rubber, etc. The pads may be wound about, adhered to, surrounding, etc. portions of the lyre as desired.

Figure 8:
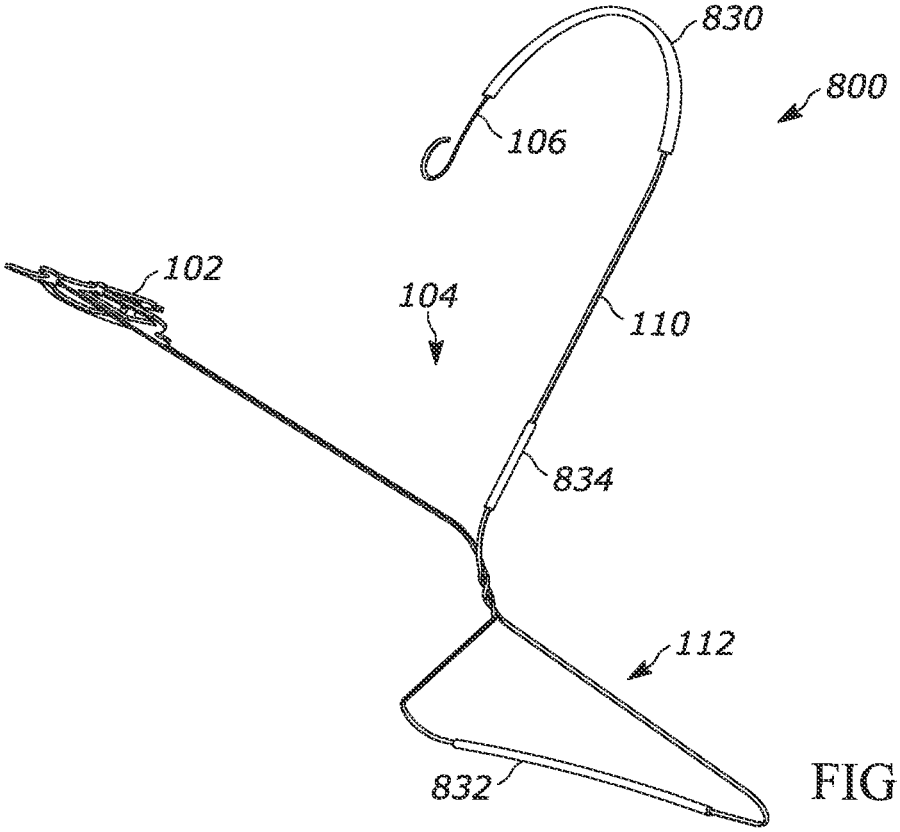
FIG. 8 is a perspective view of a flute lyre including pads, according to another example embodiment.

For example, FIG. 8 illustrates a flute lyre 800 including the music holder 102 and the body 104 of FIGS. 1-4, and pads 830, 832, 834 attached to portions of the neck member 106, the base support 112, and the arm member 110. In the example of FIG. 8, the pads 830, 832, 834 may be placed at contact regions of the neck member 106, the base support 112, and the arm member 110. The contact regions correspond to specific portions of the components that contact a user when the lyre 800 is positioned on the user. In some examples, the pads 830, 832, 834 may be used to personalize the lyre 800. For example, the pads 830, 832, 834 may be different colors, designs, etc. chosen by the user.

Figure 9:
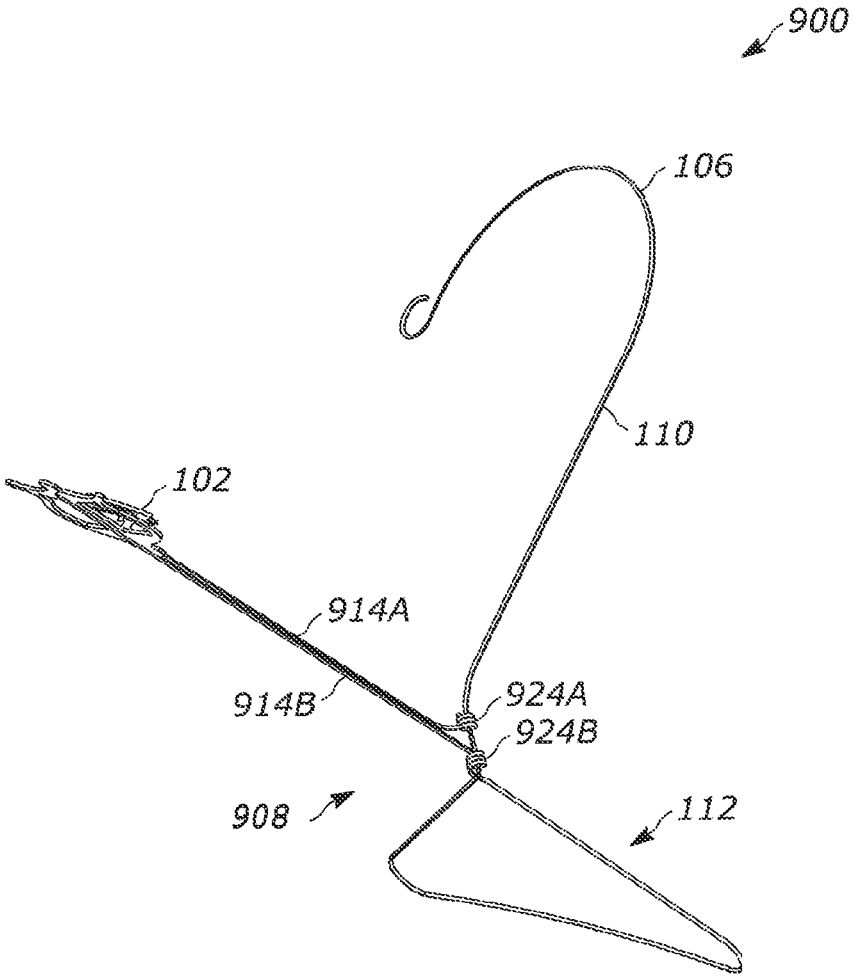
FIG. 9 is a perspective view of a flute lyre including an arm member and a music holder support twisted together, according to another example embodiment of the present disclosure.

FIG. 9 illustrates another example flute lyre 900 that is positionable on a user (e.g., a flute player) for allowing the user to read a piece of sheet music when the user holds a flute in a playing position. The flute lyre 900 of FIG. 9 is substantially similar to the flute lyre 100 of FIGS. 1-6, but includes a different music holder support configuration. Specifically, the flute lyre 900 includes the music holder 102, the neck member 106, and the arm member 110 of FIGS. 1-6, and a support member 908 having the base support 112 of FIGS. 1-6 and music holder supports 914A, 914B coupled to the arm member 110. In the example of FIG. 9, the music holder supports 914A, 914B extend in generally parallel paths between the music holder 102, and the base support 112 and the arm member 110. Additionally, the music holder 102 may be attached (e.g., brazed, soldered, welded, etc.) to the supports 914A, 914B.

As shown in FIG. 9, the music holder supports 914A, 914B are coupled to the arm member 110 near an apex of the base support 112. For example, portions of the music holder supports 914A, 914B may be twisted about the arm member 110. This forms two twists 924A, 924B around the arm member 110. In some examples, the twists 924A, 924B may be formed by at least two and half turns.

In various embodiments, the flute lyre 900 of FIG. 9 may be formed of multiple pieces of wire. For example, the music holder supports 914A, 914B including their respective twists 924A, 924B may be formed of one wire or two wires (e.g., one for each support 914A, 914B). Additionally, the neck member 106, the arm member 110, and the base support 112 may be formed of another (single) wire.

In other examples, the flute lyre 900 of FIG. 9 may be formed of one continuous piece of wire. For example, in the embodiment of FIG. 9, the neck member 106, the support member 108, the arm member 110, the base support 112, and the music holder supports 914A, 914B may be formed of (and consist of) one continuous piece of wire. In other words, every component of the flute lyre 900 except for the music holder 102 may be formed of a single, continuous piece of wire. In such examples, the music holder supports 914A, 914B may form a loop portion at one end, which may attach to the music holder 102. Additionally, in this configuration, portions of the music holder supports 914A, 914B, the arm member 110, and the base support 112 may be twisted to form a twist, a knot like configuration, etc.

The flute lyres disclosed herein may be formed by any suitable method. In the exemplary methods explained below, various steps may be employed to construct nearly the entire flute lyre 100 of FIGS. 1-6 from a single continuous piece of wire. Although the methods below are described relative to the flute lyre 100 of FIGS. 1-6, it should be apparent that the flute lyre 100 may be constructed in another suitable manner, and the same or a different method may be employed to construct another one of the flute lyres disclosed herein including, for example, the flute lyres 700, 800, 900. Additionally, any one (or all) of the various steps for constructing the flute lyres may be performed by hand (e.g., a person manipulating the wire as desired) and/or with suitable machinery.

For example, a flute lyre (e.g., the flute lyre 100 of FIGS. 1-6) may be constructed from one continuous piece of seven gauge wire of about five feet. In other examples, the wire may be another suitable gauge (e.g., six gauge, eight gauge, etc.). Additionally, the length of the wire may be longer or shorter than five feet. For example, the length of the wire may be four and half feet, five and half feet, six feet, etc. The length of wire may depend on, for example, the user's size/shape.

The method of constructing the flute lyre includes bending an intermediate portion of the wire into a triangle configuration to form a base support (e.g., the base support 112 of FIGS. 1-4). For example, the wire may be bent at about fifteen inches from a first end of the wire to form the triangle configuration. In such examples, the base support may include a bottom/base segment having a length of about six inches as explained above. In other examples, the wire may be bent at another suitable distance from the end of the wire, such as at about twelve inches, seventeen inches, twenty inches, etc.

The method further includes twisting the wire at an apex of the triangle configuration to form an arm member (e.g., the arm member 110 of FIGS. 1-4) extending in one direction and a music holder support (e.g., the music holder support 114 of FIGS. 1-4) extending in another direction. In such examples, the music holder support extends between the first end of the wire and the base support, and the arm member extends from the base support. In some examples, the wire may be twisted two and half rotations (e.g., two and half turns). In other examples, the wire may be twisted three rotations, four rotations, etc.

Additionally, in some examples, the method may include bending the wire to form a "V" configuration with the arm member and the music holder support. In such examples, the music holder support and the arm member may be separated by an angle of about 75 degrees, about 90 degrees, about 115 degrees, etc. This allows a user's arm to extend through an opening in the "V" configuration (e.g., between the arm member and the music holder support) when the lyre is positioned on the user, as explained herein.

The method further includes bending the wire into a looped configuration to form a neck member (e.g., the neck member 106 of FIGS. 1-4) extending from the arm member. For example, a portion of the wire between a second end of the wire (e.g., opposing the wire's first end) and the arm member may be bent (e.g., shaped, etc.) to form a loop (e.g., a hook, etc.) that generally corresponds to a user's neck. In such examples, the looped neck member may extend between the second end of the wire and the arm member.

In some examples, the second end of the wire may be bent to form a curl (e.g., the curl 122 of FIGS. 1-4). For example, the curl may be a tight loop that curves away from the neck member to ensure the second end of the wire does not poke (or otherwise warm) a user, snag a user's clothing, etc. when the lyre is positioned on the user.

The method further includes attaching a music holder (e.g., the music holder 102 of FIGS. 1-4) to the music holder support at the first end of the wire. For example, the music holder may be attached to the first end of the wire by any suitable manner such as brazing, soldering, welding, etc.

In some examples, the method may further include attaching a strap (e.g., the strap 724 of FIG. 7) to the base support. For example, the strap may be used to secure the lyre to a user, as explained herein. In some examples, the strap may include ends permanently or removably attached to the base support, and/or segments coupled together via a release structure support, as explained herein.

Additionally, the method may further include attaching one or more pad to at least a portion of the neck member, the base support, and/or the arm member. In such examples, the pads (e.g., the pads 830, 832, 834 of FIG. 8) may be placed at contact regions of the neck member, the base support, and the arm member to provide comfort to a user when the lyre is positioned on the user. In some examples, the pads may include suitable material such as, for example, yarn, foam, rubber, etc.

As used herein, a flute is a musical instrument including at least two openings and that is held by user. When played, the flute produces sound from a flow of air moving across one of the openings (e.g., adjacent to the user's mouth). The flute may be about 26 inches in length. As used herein, the term flute includes traditional flutes and piccolos.

Additionally, a playing position as used herein refers to the conventional posture of a user that allows the user to play a flute (including a piccolo). This conventional posture may be taken when the user is playing the flute, before the user plays the flute, and after the user plays the flute. The conventional posture includes positioning the user's left hand on a portion of the flute adjacent (e.g., proximal) to the user's mouth, and positioning the user's right hand on another portion of the flute distal to the user's mouth. When the flute is held, the user's left and right arms form roughly 90 degree angles, the user's left palm faces the user's body, and the user's right palm faces away from the user's body.

By employing the teachings disclosed herein, the flute lyres may remain stable during movements of the user's body. For example, when the user moves (e.g., marches, turns, etc.), the flute lyres remain stable against the user's body without the lyres bouncing as with conventional flute lyres. Additionally, the flute lyres may be formed of one continuous piece of material (e.g., steel wire, etc.), adjustable to accommodate users of different shapes and sizes, durable, and easy to use.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A flute lyre positionable on a user for allowing the user to read a piece of sheet music when the user holds a flute in a playing position, the flute lyre comprising:

a music holder configured to receive at least one piece of sheet music; and a body attached to the music holder, the body including:

a neck member configured to extend about and contact a posterior side of a neck of the user when the flute lyre is positioned on the user;

a support member including a base support and a music holder support extending between the base support and the music holder, the base support configured to contact an anterior side of a torso of the user when the flute lyre is positioned on the user, the music holder support positioned on an exterior side of an arm of the user when the flute lyre is positioned on the user and the user holds the flute in the playing position; and an arm member extending between the neck member and the support member, the arm member positioned between the user's arm and the anterior side of the user's torso for contacting the user's arm when the flute lyre is positioned on the user and the user holds the flute in the playing position.

2. The flute lyre of claim 1, wherein the body does not contact the flute.

3. The flute lyre of claim 1, wherein the arm member, the base support, and the music holder support are coupled together at one location of the body.

4. The flute lyre of claim 1, wherein at least one of the neck member, the support member, and the arm member are adjustable to change a position of the music holder relative to the user.

5. The flute lyre of claim 1, wherein the base support is a triangular-shaped support, and wherein the triangular-shaped support includes a base segment configured to contact the anterior side of the user's torso when the flute lyre is positioned on the user.

6. The flute lyre of claim 5, further comprising a strap including opposing ends attached to opposing sides of the triangular-shaped support, the strap configured to extend about the user's torso when the flute lyre is positioned on the user.

7. The flute lyre of claim 1, wherein the neck member, the support member, and the arm member consist of one continuous piece of wire.

8. The flute lyre of claim 7, wherein the wire is a seven gauge wire.

9. The flute lyre of claim 1, further comprising a pad attached to at least a portion of the neck member, the base support, or the arm member.

10. A method of forming a flute lyre from one continuous piece of wire, the flute lyre positionable on a user for allowing the user to read a piece of sheet music when the user holds a flute in a playing position, the method comprising:

bending an intermediate portion of the wire into a triangle configuration to form a base support configured to contact an anterior side of a torso of the user when the flute lyre is positioned on the user;

twisting the wire at an apex of the triangle configuration to form an arm member extending in a first direction and a music holder support extending in a second direction;

bending the wire into a looped configuration to form a neck member extending from the arm member, the neck member configured to extend about and contact a posterior side of a neck of the user when the flute lyre is positioned on the user; and attaching a music holder to the music holder support at an end of the wire.

11. The method of claim 10, further comprising bending the wire to form a "V" configuration with the arm member and the music holder support.

12. The method of claim 11, wherein twisting the wire at the apex of the triangle configuration includes twisting the wire at least two and one half rotations.

13. The method of claim 12, further comprising attaching a pad to at least a portion of the neck member, the base support, or the arm member.

14. The method of claim 12, further comprising attaching a strap to the base support, the strap configured to extend about the user's torso when the flute lyre is positioned on the user.

15. The method of claim 14, wherein bending the intermediate portion of the wire into the triangle configuration includes bending the wire at about fifteen inches from the end of the wire.

16. The method of claim 15, wherein the wire is about five feet in length.

17. The method of claim 16, wherein the wire is a seven gauge wire.

18. The flute lyre of claim 3, wherein the base support is a triangular-shaped support and wherein the arm member and the music holder support are coupled to form a twist at an apex of the triangular-shaped support.

19. The flute lyre of claim 1, wherein the music holder support includes a first support and a second support extending between the base support and the music holder.

20. The flute lyre of claim 19, wherein the neck member, the support member, the arm member, the base support, the first support of the music holder support, and the second support of the music holder support consist of one continuous piece of wire.

* * * * *